US012426713B2

(12) United States Patent
Lowen

(10) Patent No.: US 12,426,713 B2
(45) Date of Patent: Sep. 30, 2025

(54) PORTABLE SEAT

(71) Applicant: James Evan Lowen, Fuquay-Varina, NC (US)

(72) Inventor: James Evan Lowen, Fuquay-Varina, NC (US)

( * ) Notice: Subject to any disclaimer, the term of this patent is extended or adjusted under 35 U.S.C. 154(b) by 322 days.

(21) Appl. No.: 17/903,824

(22) Filed: Sep. 6, 2022

(65) Prior Publication Data

US 2024/0074584 A1 Mar. 7, 2024

(51) Int. Cl.

| | |
|---|---|
| ***A47C 1/14*** | (2006.01) |
| ***A47C 3/12*** | (2006.01) |
| ***A47C 3/16*** | (2006.01) |
| ***A47C 4/03*** | (2006.01) |
| ***A47C 4/28*** | (2006.01) |
| ***A47C 5/00*** | (2006.01) |
| ***A47C 5/12*** | (2006.01) |
| ***A47C 7/02*** | (2006.01) |
| ***A47C 7/20*** | (2006.01) |
| ***A47C 9/10*** | (2006.01) |

(52) U.S. Cl.

CPC ..... *A47C 1/146* (2013.01); *A47C 3/12* (2013.01); *A47C 3/16* (2013.01); *A47C 4/03* (2013.01); *A47C 4/28* (2013.01); *A47C 4/283* (2013.01); *A47C 5/12* (2013.01); *A47C 5/125* (2013.01); *A47C 7/021* (2013.01); *A47C 7/20* (2013.01); *A47C 9/10* (2013.01); *A47C 5/005* (2013.01)

(58) Field of Classification Search

CPC .. A47C 1/146; A47C 3/12; A47C 3/16; A47C 4/03; A47C 4/28; A47C 4/283; A47C 5/12; A47C 5/125; A47C 7/021; A47C 7/20; A47C 9/10; A47C 5/005

USPC ..... 297/16.1, 42, 183.1, 183.5, 229, 351, 297/440.12, 452.12, 452.19

See application file for complete search history.

(56) References Cited

U.S. PATENT DOCUMENTS 2,606,601 A * 8/1952 Saarinen ..... A47C 3/12 297/DIG. 2
2,989,112 A * 6/1961 Sonnleitner ..... A47C 3/12 297/445.1
3,009,740 A * 11/1961 Nelson ..... A47C 3/12 297/DIG. 2
3,014,762 A * 12/1961 Manser ..... A47C 31/02 297/445.1

(Continued)

FOREIGN PATENT DOCUMENTS

WO WO-0239851 A1 * 5/2002 ..... A47C 1/146

*Primary Examiner* — Robert Canfield

(74) *Attorney, Agent, or Firm* — Barry Choobin; Patent 360

(57) ABSTRACT

A portable seat that is compact for storage and could be easily carried by a user. The portable seat can be switched to a functional state that allows the user to sit at ground level while supporting a back of the user. The portable seat includes a base that has a proximal portion and a distal portion. A longitudinal cut divides the distal portion into a left section and a right section, wherein each of the left section and the right section can flex upwards or downwards, and the left section and the right sections can be pulled towards each other in an overlapping manner. Suitable fasteners can retain the distal portion in the overlapping manner. The distal portion in the overlapping manner is contoured upwards to support the back of the user.

18 Claims, 6 Drawing Sheets

(56) References Cited

U.S. PATENT DOCUMENTS

| | | | | | |
|---|---|---|---|---|---|
| 3,033,732 | A * | 5/1962 | Yellen, Jr. | A47C 7/185 | 297/452.11 |
| 3,206,251 | A * | 9/1965 | Stevens | A47C 3/12 | D6/374 |
| 3,708,367 | A * | 1/1973 | Grant | A47C 7/185 | 156/267 |
| 3,713,697 | A * | 1/1973 | Koepke | A47C 5/12 | 297/452.17 |
| 5,944,379 | A * | 8/1999 | Yates | A47C 7/021 | 297/230.12 |
| D833,165 | S * | 11/2018 | Gwynn | D6/368 | |
| 2010/0201162 | A1* | 8/2010 | Leywood | A47C 5/005 | 297/16.1 |

* cited by examiner

PORTABLE SEAT

FIELD OF INVENTION

The present invention relates to a portable seat, and more particularly, the present invention relates to a portable seat that is compact and light in weight.

BACKGROUND

Portable seats are known in the art that are compact, light in weight, and easy to carry. The portable seats are used for picnics, camping, beaches, and the like. However, the known portable seats are not that portable. The portable seats are not very compact and light in weight, which limits their use. Moreover, the portable seats can easily attract dirt and molds.

A need is therefore appreciated for a portable seat that is devoid of the limitations and drawbacks in the known portable seats.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a portable seat that is compact and light in weight.

It is another object of the present invention that the portable seat is easy to clean.

It is still another object of the present invention that the portable seat can be resistant to molds and microbes.

It is a further object of the present invention that the portable seat can provide sturdy back support.

It is yet another object of the present invention that the portable seat can be flattened for storage taking less storage.

It is a further object of the present invention that the portable seat can be economical to manufacture.

In one aspect, disclosed is a portable seat that is compact for storage and could be easily carried by a user. The portable seat can be switched to a functional state that allows the user to sit at ground level while supporting a back of the user. The portable seat comprises a base that has a proximal end and a distal end, a proximal portion is adjacent to the proximal end and a distal portion is adjacent to the distal end, the base is of an elongated, planar, and thin profile; a longitudinal cut divides the distal portion into a left section and a right section, wherein each of the left section and the right section is configured to be flexed upwards or downwards, wherein the left section and the right sections are configured to be pulled towards each other in an overlapping manner; and one or more fasteners for securing the left section to the right section in the overlapping manner. The one or more fasteners comprises a hook and loop fastener, wherein the hook and loop fastener has a first mating member and a second mating member, wherein the first mating member is provided at a bottom surface of the left section and the second mating member is provided at an upper surface of the right section. The one or more fasteners comprises two hook and loop fasteners positioned spaced apart from each other. The base comprises a plastic insert layer and an upper foam layer disposed on an upper surface of the plastic insert layer. The base further comprises a lower foam layer, wherein the plastic insert layer is sandwiched between the upper foam layer and the lower foam layer. The upper foam layer and the lower foam layer are of same dimensions and overlap each other. The base is of a pear shape, the proximal portion is narrower than the distal portion. The base further comprises a first aperture near the proximal end. The base further comprises a second aperture, wherein the longitudinal cut extends from the second aperture. The distal portion in the overlapping manner contours upwards for supporting a back of a user sitting on the portable seat.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
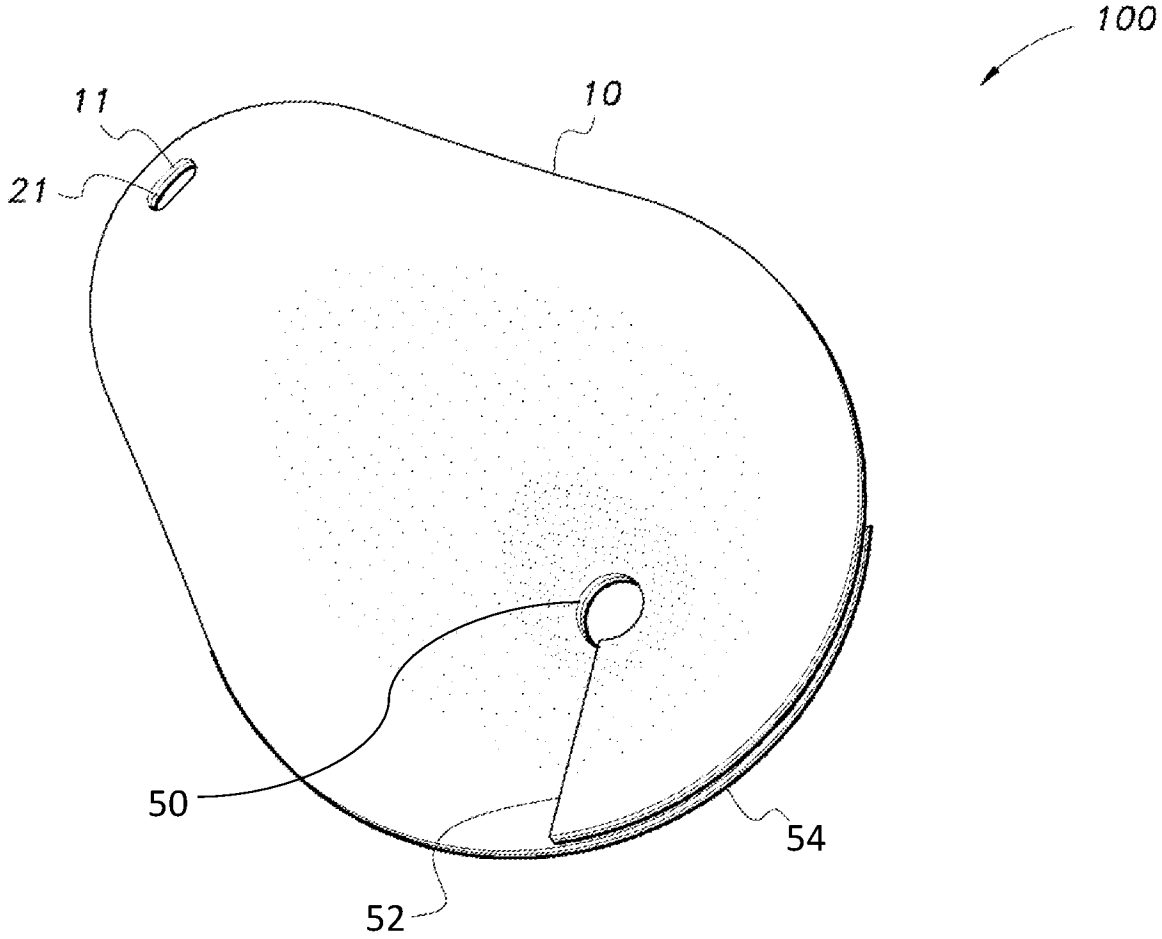
FIG. 1 is a perspective view of the portable seat in a functional state, according to an exemplary embodiment of the present invention.
Figure 2:
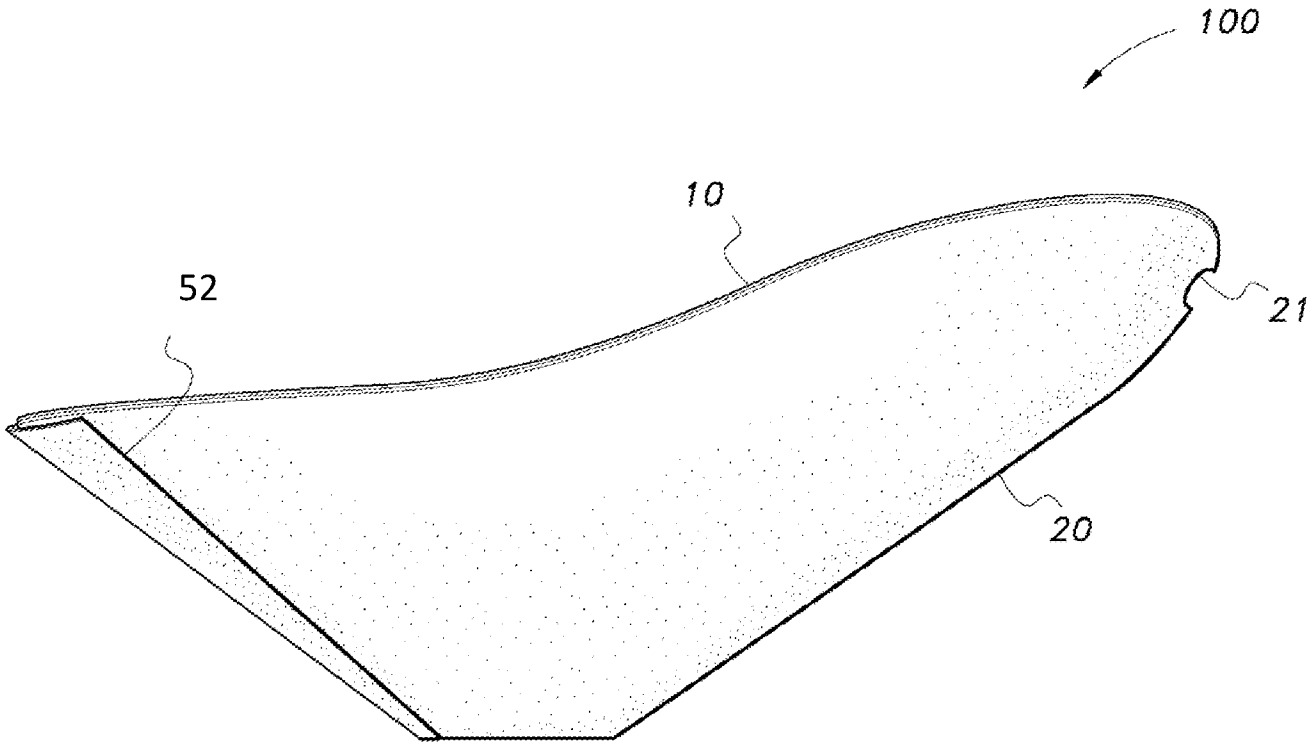
FIG. 2 is a side view of the portable seat showing the contours for supportive sitting, according to an exemplary embodiment of the present invention.

Subject matter will now be described more fully hereinafter. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as apparatus and methods of use thereof. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention since the scope of the invention will be best defined by the allowed claims of any resulting patent.

The following detailed description is described with reference to the drawings, wherein like reference numerals are used to refer to like elements throughout. In the following description, for purposes of explanation, specific details may be set forth in order to provide a thorough understanding of the subject innovation. It may be evident, however, that the claimed subject matter may be practiced without these specific details. In other instances, well-known structures and apparatus are shown in block diagram form in order to facilitate describing the subject innovation. Moreover, the drawings may not be to scale.

Disclosed is a portable seat that is compact and light in weight. The disclosed seat can be switched between a storage state and a functional state. In the storage state, the disclosed portable seat can be more compact taking very less space. In the functional state, the disclosed portable seat can be contoured for a betting seating position and to support the back of the user. The disclosed portable seat can be manufactured from materials that resist the growth of molds and can be easy to clean.

Figure 3:
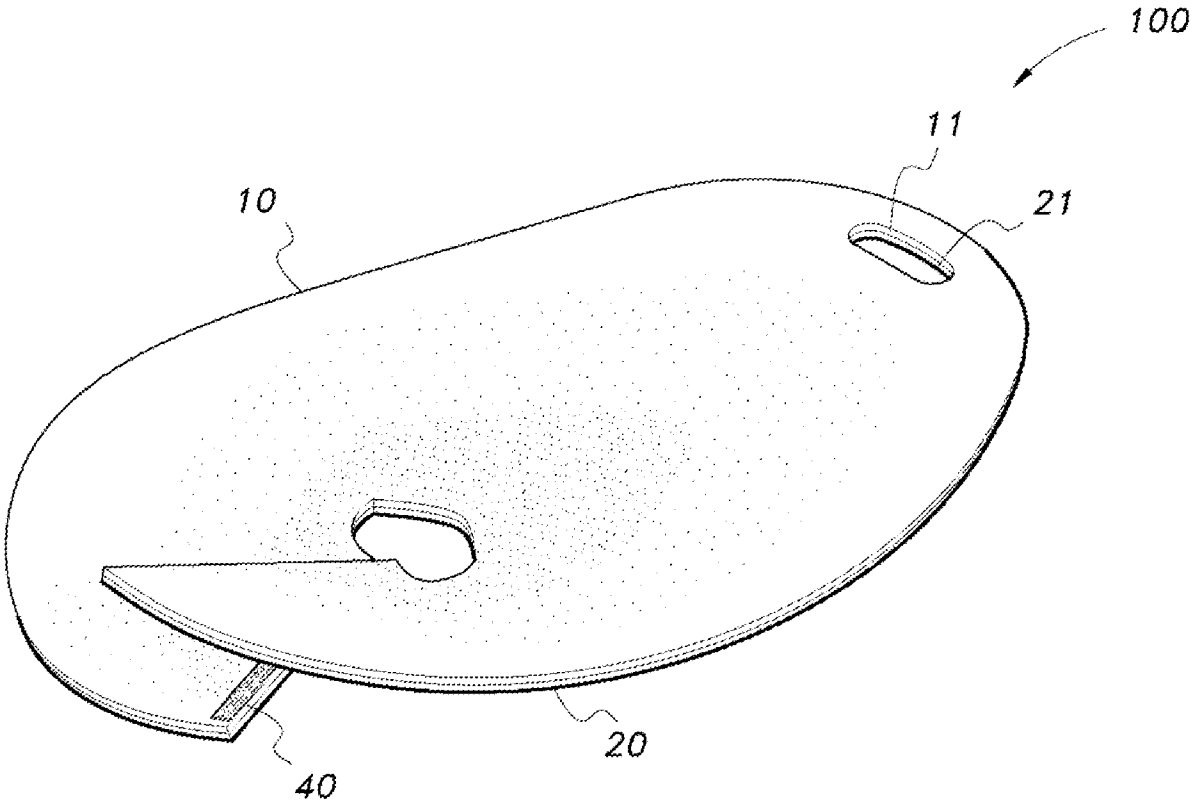
FIG. 3 is an alternate perspective view of the portable seat showing a fastener, according to an exemplary embodiment of the present invention.
Figure 4:
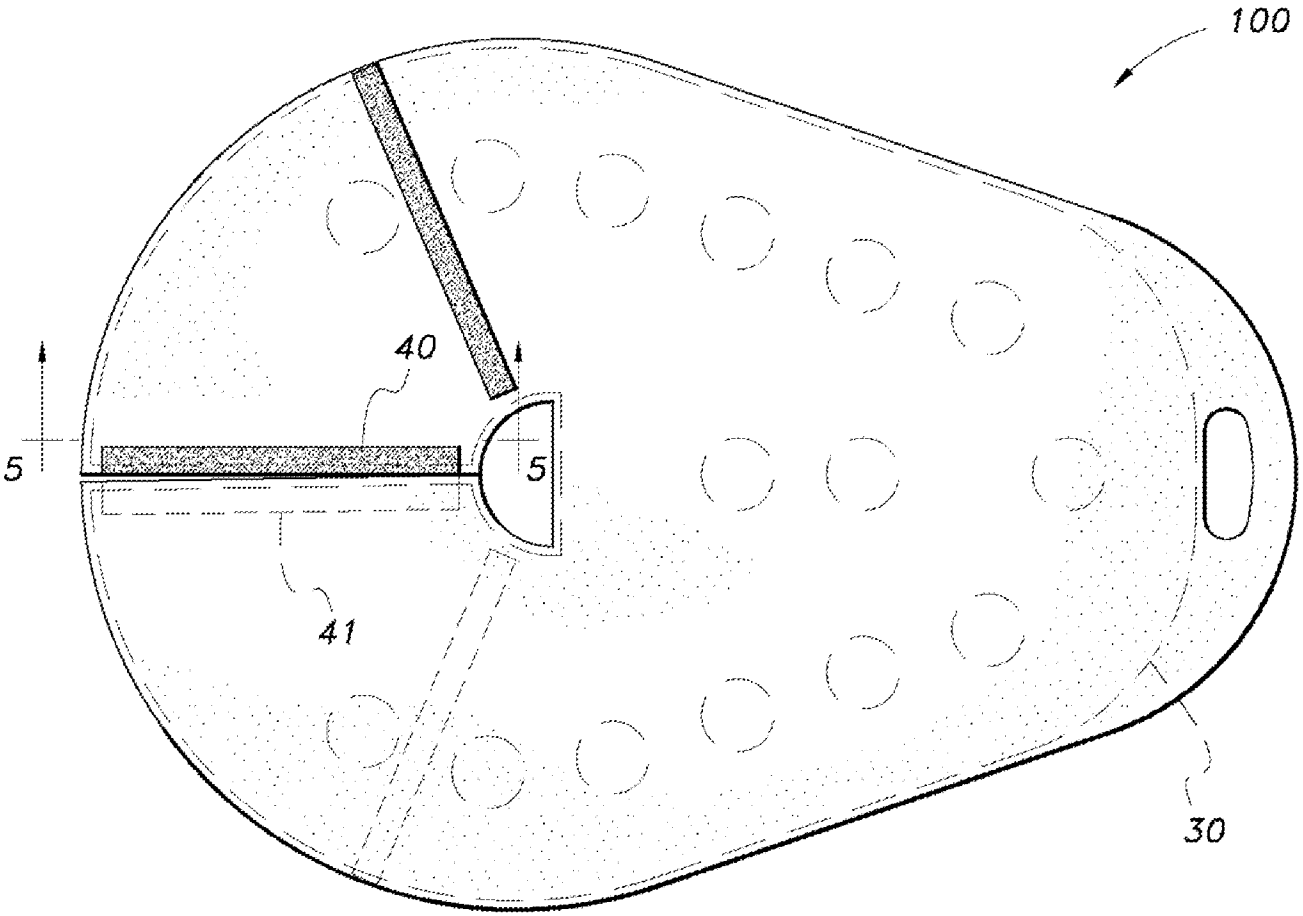
FIG. 4 shows a schematic view showing the reinforcing plastic insert, lower foam layer, and two fasteners, according to an exemplary embodiment of the present invention.
Figure 5:
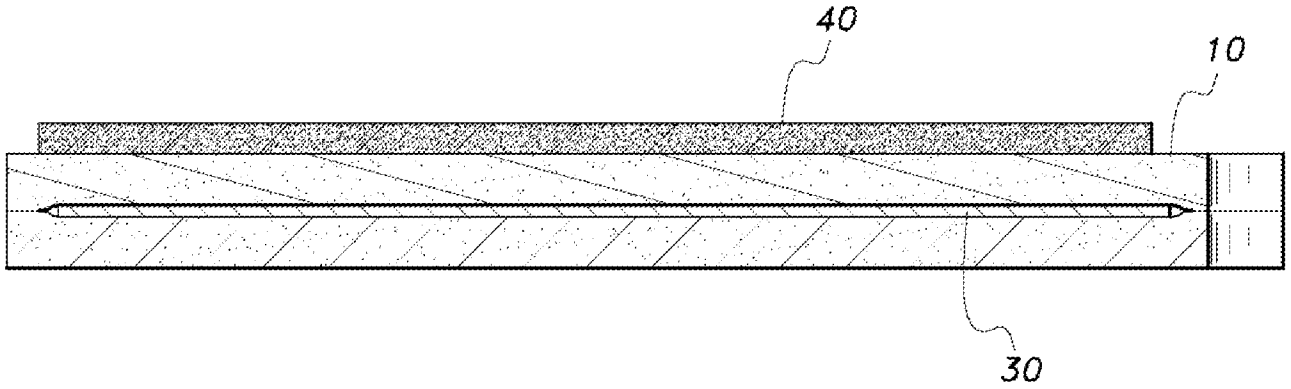
FIG. 5 is a sectional view taken along the line 5-5' of FIG. 4, according to an exemplary embodiment of the present invention.
Figure 6:
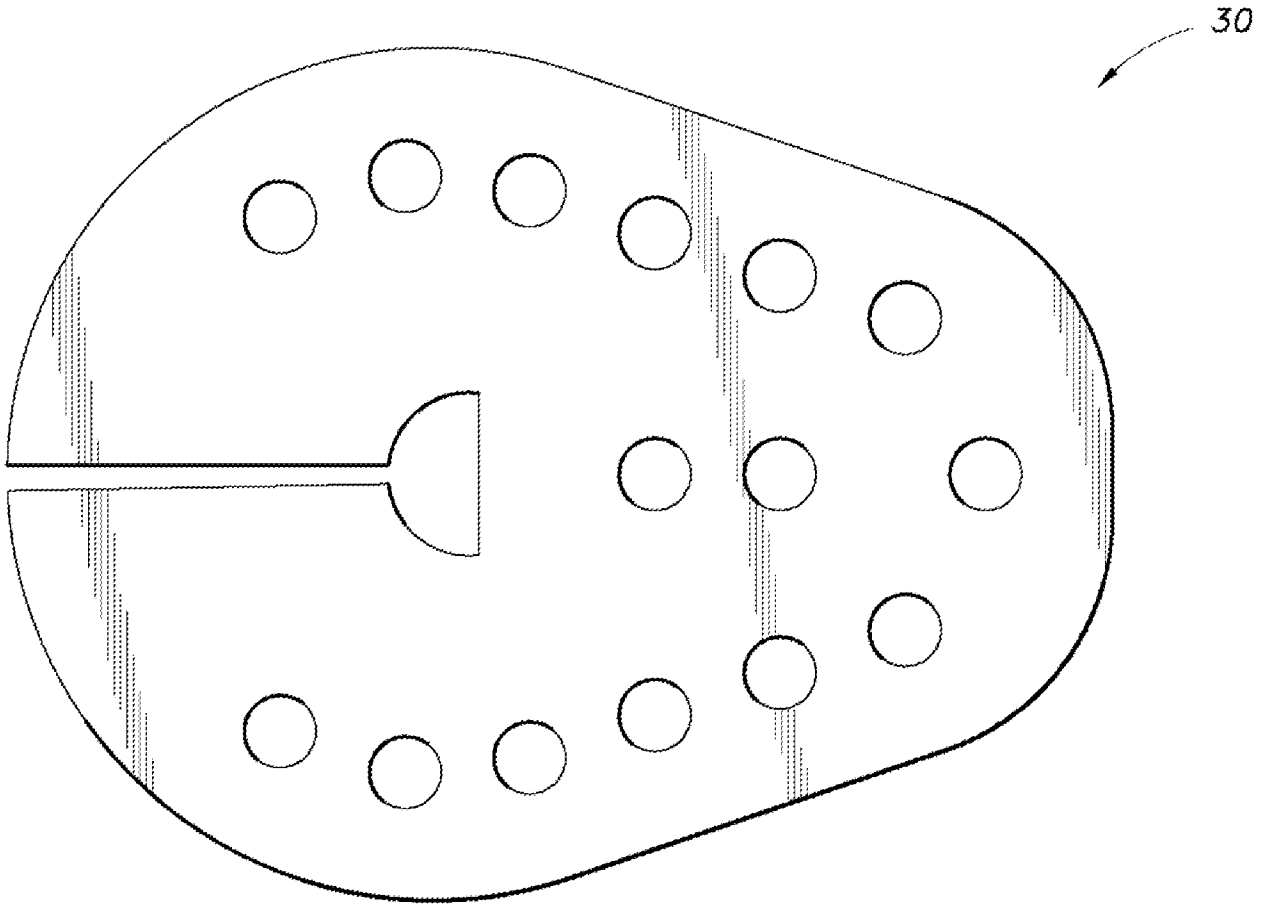
FIG. 6 is a top view of a reinforcing plastic insert of the portable seat, according to an exemplary embodiment of the present invention.

Referring to FIGS. 1-6 which show an exemplary embodiment of the portable seat 100. The portable seat 100 can include base 10 that includes a plastic insert 30, an upper foam layer disposed on top of the plastic insert 30, and a lower foam layer 20 on the bottom of the plastic insert. The portable seat 100 can have a front end and a rear end. The rear end of the portable seat can be at the rear of the portable seat that can support the back of the user sitting on the seat. As shown in FIG. 4, the plastic insert can be lesser in area than the upper form layer and the lower foam layer, wherein the upper foam layer and the lower foam layer can be of the same size.

The upper foam layer can have a first slot 11 and the lower foam layer can have a second slot 21, wherein the first slot and the second slot can form a pass-through hole in the portable seat 100. More clearly shown in FIG. 4, this hole formed by slots 11 and 21 can be away from the plastic insert 30 near the front end of the portable seat 100. The pass-through hole near the front end of the portable seat 100 can be used to hang the disclosed portable seat 100 or carry the disclosed portable seat 100. The pass-through hole can also be used to tie multiple units of the portable seats stacked one over another.

The upper foam layer and the lower foam layer can overlap sandwiching the reinforcing plastic insert. The reinforcing plastic insert can impart the desired shape to the portable seat that is comfortable and supportive for sitting. The reinforcing plastic insert imparts the desired contouring and geometry to the disclosed portable seat for sitting.

The rear end portion of the portable seat has a second hole 50 that is at about the middle of the rear end portion. A cut-out extends from this second hole 50 to the rear end periphery of the portable seat 100 that divides the rear end portion of the portable seat into a left section 52 and a right section 54. The left section and the right section can be flexed and bought towards each other and then passed each other such that the left section can overlie the right section. In use, a user can grasp the left section and the right section in his hands. The left section and the right piece section be slightly flexed in opposite directions and thereafter, the left section and the right section can be bought closer one over the other so that the left section overlies the right section, as shown in FIG. 3. This results in contouring of the portable seat for sitting wherein the folded and upward flexed rear portion of the portable seat can support the back of the user sitting on the disclosed portable seat. This state of the disclosed portable seat has been referred to as the functional state.

One or more fasteners can be used to lock the left section and the right section in the overlapped position. In one implementation, a hook and loop fastener can be used, wherein a male member 40 of the hook and loop fastener can be provided on the bottom surface of the left section and a female member 41 of the hook and loop fastener can be provided on a top surface of the right section. When the left section overlies the right section, the male member of the hook and loop fastener can be mated with the female member for securing the overlapping left section and the right section. More than one spaced apart hook and loop fasteners can be used. FIG. 4 shows two such hook and loop fasteners spaced apart from each other and can secure the left section to the right section in an overlapping fashion. After use, the fastener can be disengaged, and the left piece and the right piece can revert to their original position.

It is understood, however, that fasteners other than hook and loop fasteners can be used without departing from the scope of the present invention. For example, snap buttons as fasteners can be used to secure the left section to the right section. More than one fastener can be used for strength preventing accidental fall apart of the left section and right section.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A portable seat comprising:

a base that has a proximal end and a distal end, a proximal portion is adjacent to the proximal end and a distal portion is adjacent to the distal end, the base is of an elongated and planar profile;

a longitudinal cut divides the distal portion into a left section and a right section, wherein each of the left section and the right section is configured to be flexed upwards or downwards, wherein the left section and the right sections are configured to be pulled towards each other in an overlapping manner, wherein the left section and the right section when overlapped results in contouring of the distal portion; and one or more fasteners for securing the left section to the right section in the overlapping manner, wherein the base comprises a plastic insert layer and an upper foam layer disposed on an upper surface of the plastic insert layer, wherein the distal portion has a semi-circular hole, and the longitudinal cut extends from the semi-circular hole, wherein the upper foam layer and the lower foam layer are of same dimensions and overlap each other.

2. The portable seat according to claim 1, wherein the one or more fasteners comprises a hook and loop fastener, wherein the hook and loop fastener has a first mating member and a second mating member, wherein the first mating member is provided at a bottom surface of the left section and the second mating member is provided at an upper surface of the right section.

3. The portable seat according to claim 2, wherein the one or more fasteners comprises two hook and loop fasteners positioned spaced apart from each other.

4. The portable seat according to claim 1, wherein the base further comprises a lower foam layer, wherein the plastic insert layer is sandwiched between the upper foam layer and the lower foam layer.

5. The portable seat according to claim 1, wherein the base is of a pear shape, the proximal portion is narrower than the distal portion.

6. The portable seat according to claim 1, wherein the base further comprises a first aperture in the proximal portion.

7. The portable seat according to claim 1, wherein the contouring is upwards for supporting a back of a user sitting on the portable seat.

8. A method for permitting a user to sit comfortably, the method comprising:

providing a portable seat comprising:

a base that has a proximal end and a distal end, a proximal portion is adjacent to the proximal end, and a distal portion is adjacent to the distal end, the base is of an elongated and planar profile, wherein the base comprises a plastic insert layer and an upper foam layer disposed on an upper surface of the plastic insert layer, wherein the base further comprises a lower foam layer, wherein the plastic insert layer is sandwiched between the upper foam layer and the lower foam layer, wherein the upper foam layer and the lower foam layer are of same dimensions and overlap each other, a longitudinal cut divides the distal portion into a left section and a right section, wherein each of the left section and the right section is configured to be flexed upwards or downwards, wherein the left section and the right sections are configured to be pulled towards each other in an overlapping manner, and one or more fasteners for securing the left section to the right section in the overlapping manner; and overlapping the left section over the right section.

9. The method according to claim 8, wherein the one or more fasteners comprises a hook and loop fastener, wherein the hook and loop fastener has a first mating member and a second mating member, wherein the first mating member is provided at a bottom surface of the left section and the second mating member is provided at an upper surface of the right section.

10. The method according to claim 9, wherein the one or more fasteners comprises two hook and loop fasteners positioned spaced apart from each other.

11. The method according to claim 8, wherein the base is of a pear shape, the proximal portion is narrower than the distal portion.

12. The method according to claim 8, wherein the base further comprises a first aperture in the proximal portion.

13. The method according to claim 12, wherein the base further comprises a second aperture, wherein the longitudinal cut extends from the second aperture.

14. The method according to claim 8, wherein the distal portion in the overlapping manner contours upwards for supporting a back of a user sitting on the portable seat.

15. A portable seat comprising:

a base that has a proximal end and a distal end, a proximal portion is adjacent to the proximal end, and a distal portion is adjacent to the distal end, the base is of an elongated and planar profile, wherein the base comprises a plastic insert layer and an upper foam layer disposed on an upper surface of the plastic insert layer, wherein the base further comprises a lower foam layer, wherein the plastic insert layer is sandwiched between the upper foam layer and the lower foam layer, wherein the upper foam layer and the lower foam layer are of same dimensions and overlap each other, a longitudinal cut divides the distal portion into a left section and a right section, wherein each of the left section and the right section is configured to be flexed upwards or downwards, wherein the left section and the right sections are configured to be pulled towards each other in an overlapping manner, and one or more fasteners for securing the left section to the right section in the overlapping manner.

16. The portable seat according to claim 15, wherein the one or more fasteners comprises a hook and loop fastener, wherein the hook and loop fastener has a first mating member and a second mating member, wherein the first mating member is provided at a bottom surface of the left section and the second mating member is provided at an upper surface of the right section.

17. The portable seat according to claim 16, wherein the one or more fasteners comprises two hook and loop fasteners positioned spaced apart from each other.

18. The portable seat according to claim 15, wherein the base further comprises a second aperture, wherein the longitudinal cut extends from the second aperture, wherein the distal portion in the overlapping manner contours upwards for supporting a back of a user sitting on the portable seat.

* * * * *